United States Patent [19]

Ochiai

[11] Patent Number: 4,841,789

[45] Date of Patent: Jun. 27, 1989

[54] DRIVE SYSTEM FOR DRIVING VALVES AND AN AUXILIARY MACHINE OF AN AUTOMOTIVE ENGINE

[75] Inventor: Katsumi Ochiai, Mitaka, Japan

[73] Assignee: Fuji Jikogyo Kabushiki Kaisha, Tokyo, Japan

[21] Appl. No.: 221,930

[22] Filed: Jul. 20, 1988

[30] Foreign Application Priority Data

Jul. 31, 1987 [JP] Japan ..... 62-191847

[51] Int. Cl.[4] ..... F02B 67/06

[52] U.S. Cl. ..... 74/15.63; 123/90.31; 474/84; 474/86

[58] Field of Search ..... 74/15.63; 123/90.31; 474/84, 86, 87, 88

[56] References Cited

U.S. PATENT DOCUMENTS

| | | | |
|---|---|---|---|
| 1,832,958 | 11/1931 | Bachle | 474/87 |
| 2,010,056 | 8/1935 | Brush | 74/242.10 |
| 3,176,528 | 4/1965 | Hill | 72/226 |
| 4,177,689 | 12/1979 | Zeilinger et al. | 74/242.8 |
| 4,553,473 | 11/1985 | Ichida et al. | 92/261 |
| 4,617,882 | 10/1986 | Matsumoto | 123/90.31 |
| 4,671,223 | 6/1987 | Asano et al. | 123/90.31 |

FOREIGN PATENT DOCUMENTS

| | | | |
|---|---|---|---|
| 2022671 | 12/1971 | Fed. Rep. of Germany | 474/87 |
| 56-113127 | 9/1981 | Japan . | |
| 62-32203 | 2/1987 | Japan | 123/90.31 |
| 421359 | 12/1934 | United Kingdom | 474/86 |

*Primary Examiner*—Leslie A. Braun
*Assistant Examiner*—Scott Anchell
*Attorney, Agent, or Firm*—Martin A. Farber

[57] ABSTRACT

A driving system for driving valves and an auxiliary machine has a gear train for transmitting power of an engine from a crankshaft to a drive shaft, a first belt drive device for transmitting the power from the drive shaft to a camshaft of the engine, and a second belt drive device for transmitting the power from the crankshaft to a shaft of an auxiliary machine. The first belt drive device and the second drive device are disposed on a same plane with respect to the crankshaft.

11 Claims, 4 Drawing Sheets

FIG. 2
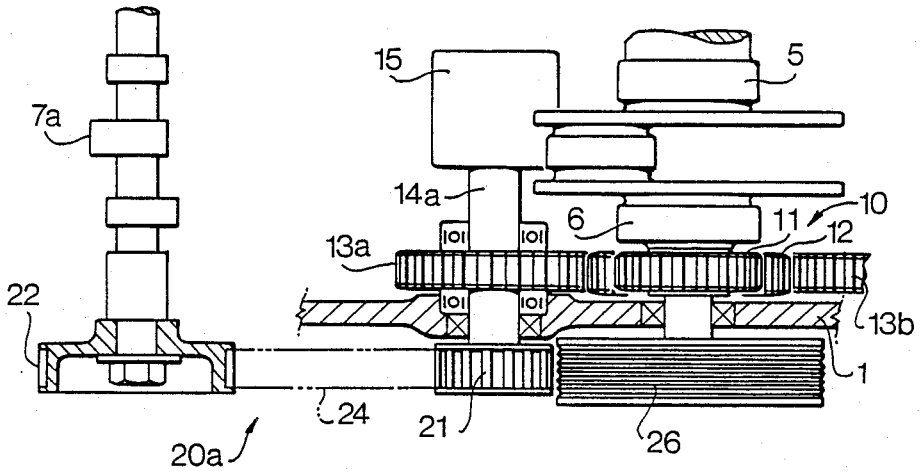
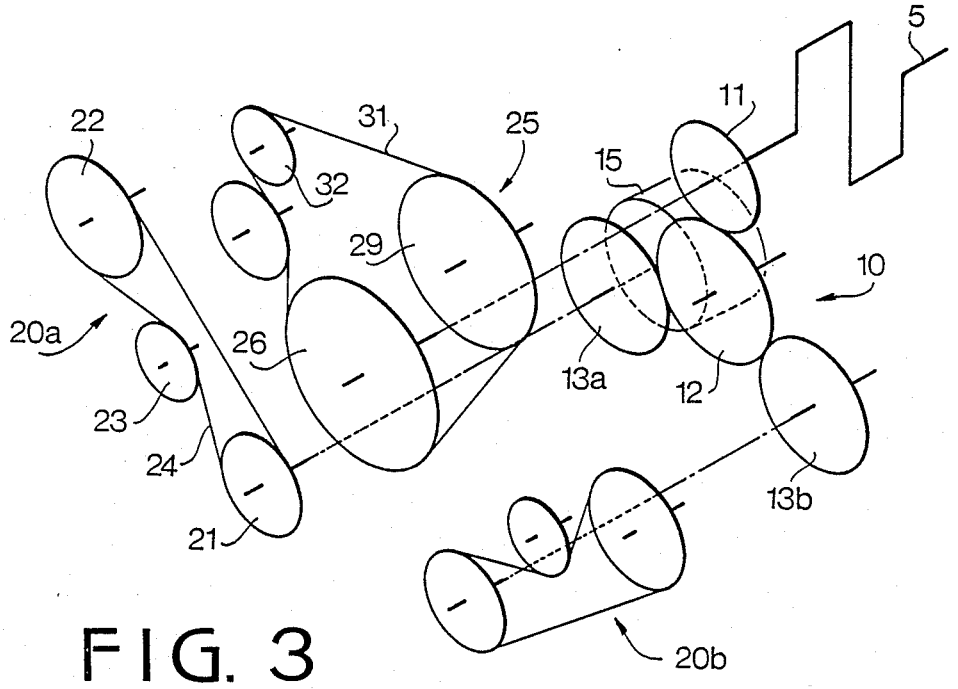
FIG. 3

DRIVE SYSTEM FOR DRIVING VALVES AND AN AUXILIARY MACHINE OF AN AUTOMOTIVE ENGINE

BACKGROUND OF THE INVENTION

The present invention relates to a drive system for driving valves and auxiliary machinery by a crankshaft of an overhead camshaft engine for a motor vehicle, and more particularly to an arrangement of timing belts in the system.

Japanese Utility Model Laid Open No. 56-113127 discloses an automotive engine wherein an oil pump is mounted on a crankshaft of the engine. A crankshaft pulley engaged with a timing belt for driving a camshaft is secured to the crankshaft at a position outside the oil pump, and an auxiliary machinery driving pulley engaged with a driving belt for driving an auxiliary machine is securely mounted on the crankshaft outside the crankshaft pulley. In the system, since the oil pump and pulleys are all disposed in different vertical planes with respect to the crankshaft, the outermost pulley projects considerably out of the crankcase so that the length of the engine increases. Additionally, the system is arranged to directly drive a camshaft pulley from the crankshaft pulley through the timing belt. Accordingly the gear ratio for the camshaft is determined by the ratio between the diameters of both of the pulleys. In order to provide an appropriate gear ratio, the diameter of the camshaft pulley becomes much larger than that of the crankshaft pulley. Thus, durability and operativity of the timing belt are not good.

SUMMARY OF THE INVENTION

The object of the present invention is to provide a driving system for driving valves and an auxiliary machine of an engine whereby the length of the engine may be shortened and the gear ratio between adjacent gears can be reduced.

The other objects and features of this invention will become understood from the following description with reference to the accompanying drawings.

BRIEF DESCRIPTION OF THE DRAWINGS

FIG. 2 is a sectional view of a part of the engine of FIG. 1;

FIG. 3 is a schematic perspective view of a part of the engine;

DETAILED DESCRIPTION OF THE PREFERRED EMBODIMENTS

Figure 1:
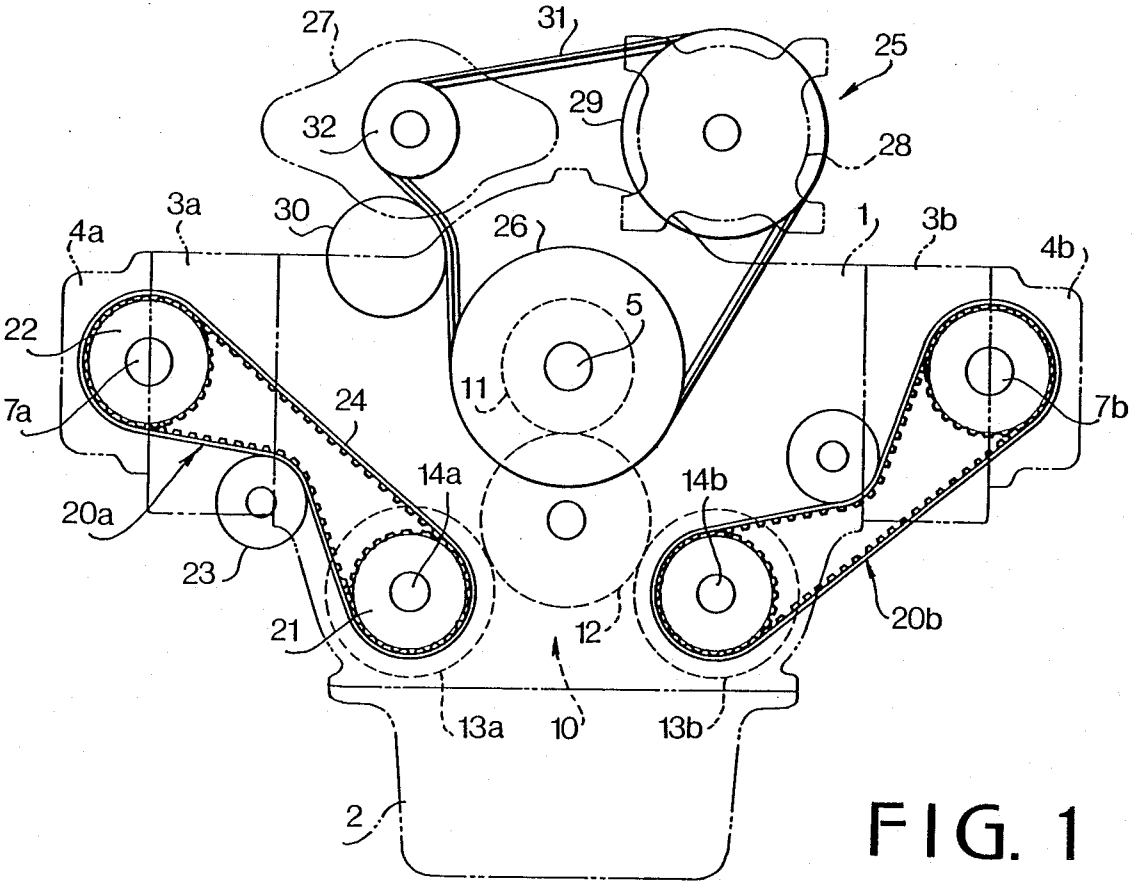
FIG. 1 is a front elevational view of an opposed flat engine to which the present invention is applied.

Referring to FIGS. 1 to 3, an opposed flat engine comprises a crankcase 1 wherein a crankshaft 5 is disposed at the center portion thereof, and an oil pan 2 underneath the crankcase 1. On both lateral sides of the crankcase 1, cylinder heads 3*a* and 3*b* and cylinder head covers 4*a* and 4*b*, which respectively house belt drive devices 20*a* and 20*b* for valves, are integrally provided. A gear train 10 is provided in the crankcase 1 adjacent a first journal 6 (FIG. 2) of the crankshaft 5, which s provided at a front side portion of the engine.

The gear train 10 comprises a drive gear 11 securely mounted on the crankshaft 5, an idler gear 12 meshing with the drive gear 11, and a pair of driven gears 13*a* and 13*b* meshing with the idler gear 12 and securely mounted on driven gear shafts 14*a* and 14*b*, respectively. Thus, the driven gears 13*a*, 13*b* are disposed apart from a vertical plane passing through the crankshaft 5. An oil pump 15 is provided on the driven gear shaft 14*a* in the crankcase 1 so as to be driven by the crankshaft 5.

One of the belt drive devices 20*a* and 20*b* as a part of a valve train is described hereinafter. A cam drive pulley 21 is securely mounted on an extended portion of the driven gear shaft 14*a* outside the crankcase 1. The cam drive pulley 21 is connected through a toothed timing belt 24 to a cam driven pulley 22 securely mounted on a camshaft 7*a*. A tension pulley 23 bears on the timing belt at the slack side. Since the cam drive pulley 21, as well as the driven gear 13*a*, is disposed apart from the crankshaft 5, the timing belt 24 is so disposed as to be clear of the crankshaft 5. The other belt drive device 20*b* for the other valve train, having the driven gear 13*b* and a camshaft 7*b*, is constructed and disposed in the same manner as the belt drive device 20*a*.

An auxiliary machinery driving means 25 is disposed in the same vertical plane passing through belt drive devices 20*a* and 20*b*. The auxiliary machinery driving means 25 comprises a crankshaft pulley 26 securely mounted on the crankshaft 5, a pulley 32 for an alternator 27, and a pulley 29 for a compressor 28. The alternator 27 and compressor 28 are disposed on the top of the crankcase 1. A belt 31 engages with the pulleys 26, 29 and 32 and a tension pulley 30 bears on the belt thereby driving the compressor 28 and alternator 27. Although the belt 31 is positioned in the same plane as the timing belt 24, the belts do not interfere with each other.

In operation, when the crankshaft 5 is rotated, the gear train 10 is driven, thereby actuating the belt drive devices 20*a* and 20*b*. Accordingly, the camshafts 7*a* and 7*b* are rotated to operate the valves. At the same time, the auxiliary machinery, that is, the alternator 27 and compressor 28 are directly driven by the crankshaft pulley 26 on the crankshaft 5, and the belt 31.

In the present invention, the gear ratio e between the gear 11 and the cam driven pulley 22 can be represented as follows.

$$e = zd/zc \cdot zn/zm$$

where zc, zd, zm and zn are the numbers of teeth of the drive gear 11, driven gear 13*a*, cam drive pulley 21 and cam driven pulley 22, respectively. Supposing that the gear ratio e is 2 and the ratio zd/zc is 3/2, the ratio zn/zm becomes 4/3. In the conventional art wherein the cam drive pulley is directly mounted on the crankshaft, in order to obtain the same gear ratio e, the ratio zn/zm between a cam drive pulley and cam driven pulley must be 2, namely, the diameter of the cam driven pulley must be twice as large as that of the cam drive pulley. In the present invention, the cam driven pulley 22 has a diameter slightly larger than that of the cam drive pulley 21.

Figure 4A:
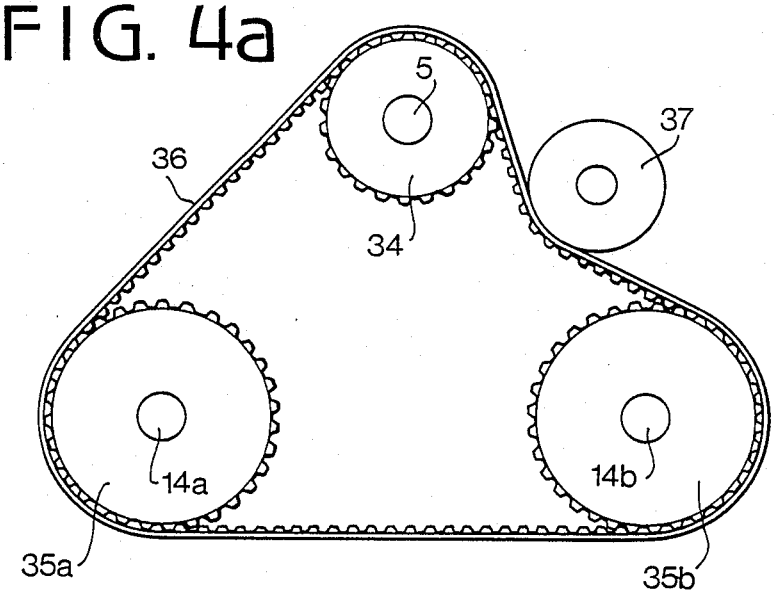
FIGS. 4*a* and 4*b* show other embodiments of the invention.
Figure 4B:
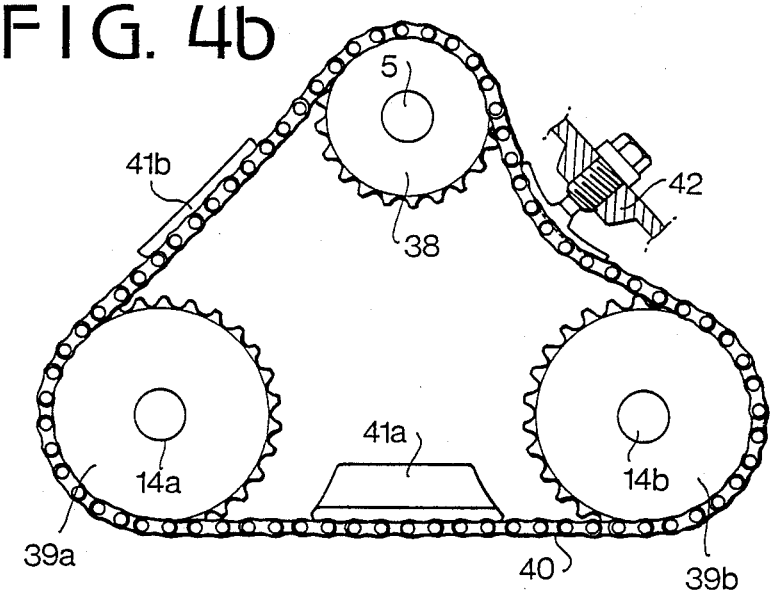

In other examples of the present invention, the gear train 10 may be substituted by a pulley and belt device or a sprocket and chain device. Referring to FIG. 4*a*, a drive pulley 34 fixedly mounted on the crankshaft 5 is connected to driven pulleys 35*a* and 35*b* mounted on the shafts 14*a* and 14*b* through at toothed belt 36. A tension pulley 37 is urged against the belt 36 at the slack side between the drive pulley 34 and driven pulley 35*b*. In FIG. 4*b*, sprockets 39*a* and 39*b* are driven by a sprocket 38 mounted on the crankshaft 5 through a chain 40, which is guided by chain guides 41*a* and 41*b* and tensed by a tensioner 42.

Figures 5A, 5B:
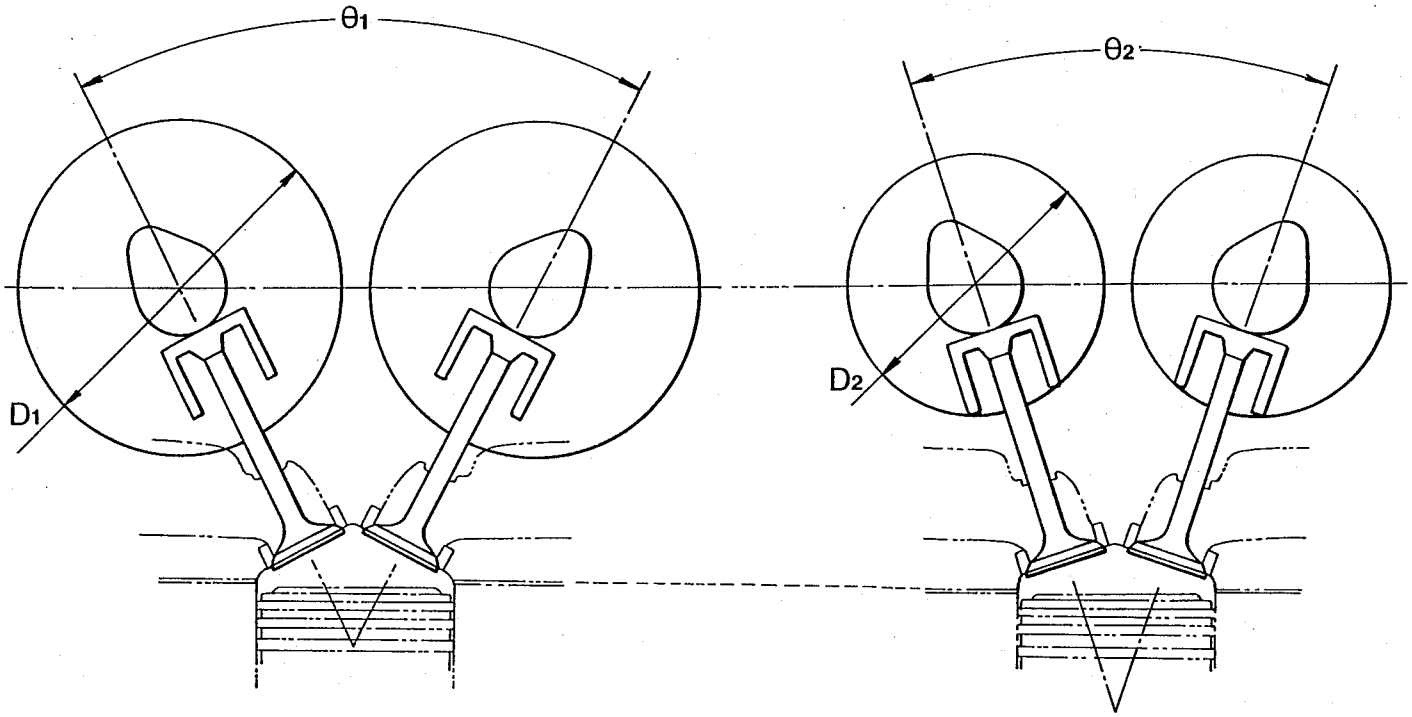
FIG. 5a PRIOR ART
FIGS. 5*a* and 5*b* are schematic diagrams showing arrangement of valves of double overhead camshaft engines, respectively.

The present invention may be applied to a double overhead camshaft engine as shown in FIG. 5*b*. Since the diameter D2 of the cam driven pulley in the present invention is smaller than the diameter D1 of the cam driven pulley in the prior art shown in FIG. 5*a*, the angle $\theta 2$ between the valves becomes smaller than the angle $\theta 1$. Therefore, a compact engine can be obtained.

Other auxiliary machinery, such as a water pump and power steering pump, may be mounted on the shaft 14*a* instead of, or in addition to the oil pump 15.

From the foregoing, it will be understood that the present invention provides an engine wherein a belt drive device and a driving system for driving auxiliary machinery are provided in the same vertical plane with respect to a crankshaft of the engine without interfering with each other. Therefore, the overall length of the engine can be decreased. Accordingly, the length of the crankshaft is decreased thereby improving the torsional strength thereof. Furthermore, since the gear ratio between the pulleys of the timing belt is decreased, the diameter of the cam drive pulley can be increased. Therefore, the number of teeth of the cam drive pulley which engages with the teeth of the timing belt is increased, thereby improving the durability of the belt. A further advantage of the present invention lies in that, when applied to a double overhead camshaft engine, the angle between the valves can be reduced so as to decrease the size of the engine.

While presently preferred embodiments of the present invention have been shown and described, it is to be understood that this disclosure is for the propose of illustration and that various changes and modifications may be made without departing from the scope of the invention as set forth in the appended claims.

What is claimed is:

1. A driving system for driving intake and exhaust valves and auxiliary machines of an automotive engine having a crankshaft, comprising:

a drive gear securely mounted on said crankshaft at one end thereof;

a crankshaft pulley securely mounted on said crankshaft at an outermost end portion of the crankshaft whereby said drive gear is positioned between said engine and said crankshaft pulley;

an idler gear;

a driven gear meshed with said drive gear through said idler gear;

a drive pulley connected coaxially to said driven gear;

first means for driving said valves through said drive pulley;

second means for driving said auxiliary machines from said crankshaft pulley; and both said first and second means are disposed in a common plane perpendicular to said crankshaft.

2. The system according to claim 1 wherein the first means comprises a belt drive device provided between the drive pulley and a camshaft.

3. The system according to claim 1 wherein the second means comprises a belt drive device provided between the crankshaft and the auxiliary machine.

4. A driving system according to claim 1, wherein said driven gear and said drive pulley are rotationally connected by a driven gear shaft, and said driven gear shaft is spaced laterally apart from said crankshaft.

5. A driving system according to claim 1, wherein said first means includes a cam driven pulley which has a diameter slightly larger than that of the drive pulley, and a toothed timing belt which engages both said cam driven pulley and said drive pulley.

6. A driving system according to claim 5, wherein said engine is a double overhead camshaft engine.

7. A driving system according to claim 1 further comprising a crankcase, and said first and second means including said crankshaft pulley and said drive pulley are disposed outside said crankcase, and said gears are mounted inside said crankcase.

8. A driving system according to claim 1, wherein said first and second means each comprises a pulley belt disposed in said common plane.

9. A driving system according to claim 1, wherein said engine is a double overhead camshaft engine.

10. A driving system for driving intake and exhaust valves and auxiliary machines of an automotive engine having a crankshaft, comprising:

a drive pulley securely mounted on said crankshaft at one end thereof;

a crankshaft pulley securely mounted on said crankshaft at an outermost end portion of the crankshaft whereby said drive pulley is positioned between said engine and said crankshaft pulley;

a belt;

a driven pulley, said belt engages said driven pulley and said drive pulley;

a second drive pulley connected coaxially to said driven pulley;

first means for driving said valves through said second drive pulley;

second means for driving said auxiliary machines from said crankshaft pulley; and both said first and second means are disposed in a common plane perpendicular to said crankshaft.

11. A driving system for driving intake and exhaust valves and auxiliary machines of an automotive engine having a crankshaft, comprising:

a drive sprocket securely mounted on said crankshaft at one end thereof;

a crankshaft pulley securely mounted on said crankshaft at an outermost end portion of the crankshaft whereby said drive sprocket is positioned between said engine and said crankshaft pulley;

a chain;

a driven sprocket, said chain meshes with said drive and said driven sprockets;

a driven pulley connected coaxially to said driven sprocket;

first means for driving said valves through said drive pulley;

second means for driving said auxiliary machines from said crankshaft pulley; and both said first and second means are disposed in a common plane perpendicular to said crankshaft.

* * * * *